US006485158B1

(12) United States Patent
Bisotto

(10) Patent No.: US 6,485,158 B1
(45) Date of Patent: Nov. 26, 2002

(54) INFLATABLE ILLUMINATION DEVICE

(76) Inventor: Riccardo Bisotto, 2nd Floor, 26 Sussex Place, London W2 2TH, England (GB)

( * ) Notice: Subject to any disclaimer, the term of this patent is extended or adjusted under 35 U.S.C. 154(b) by 0 days.

(21) Appl. No.: 09/597,431

(22) Filed: Jun. 20, 2000

(51) Int. Cl.[7] ..... A63H 33/22

(52) U.S. Cl. ..... 362/34; 362/96; 362/253; 362/467

(58) Field of Search ..... 362/34, 96, 467, 362/244, 253; 446/219, 220, 221; 206/222

(56) References Cited

U.S. PATENT DOCUMENTS 3,800,132 A * 3/1974 Pstal ..... 362/34
4,015,111 A * 3/1977 Spector ..... 240/2.25
5,557,869 A * 9/1996 Douglas ..... 40/542
5,860,845 A * 1/1999 Goyrach ..... 446/219
6,106,135 A * 8/2000 Zingale et al. ..... 362/186
6,371,624 B1 * 4/2002 Dorney ..... 362/34
6,398,616 B1 * 6/2002 Motosko, III ..... 446/220

* cited by examiner

*Primary Examiner*—Stephen Husar
*Assistant Examiner*—Anabel Ton

(57) ABSTRACT

An inflatable chemiluminescent system for illuminating balloons through a chemical reaction comprising, includes a balloon fabricated of an elastic, air impervious material, preferably rubber, natural or synthetic or blends thereof. The balloon is generally shaped in a spherical configuration when inflated to include an upper extent, a lower extent with an inflation/deflation opening, and an intermediate extent there between. The intermediate extent of the balloon is bounded by an upper plane and a parallel lower plane of a common diameter, with a central plane of a circular configuration having a diameter greater than that of the upper and lower planes. A plurality of luminescent chemicals with the first luminescent chemical located at the central extent and a second luminescent chemical located at the central extent remote from the first luminescent chemical. The chemicals are adapted to intermix and cause an illumination most predominate at the central extent of the balloon which is visible from exteriorly thereof.

3 Claims, 3 Drawing Sheets

FIG 3
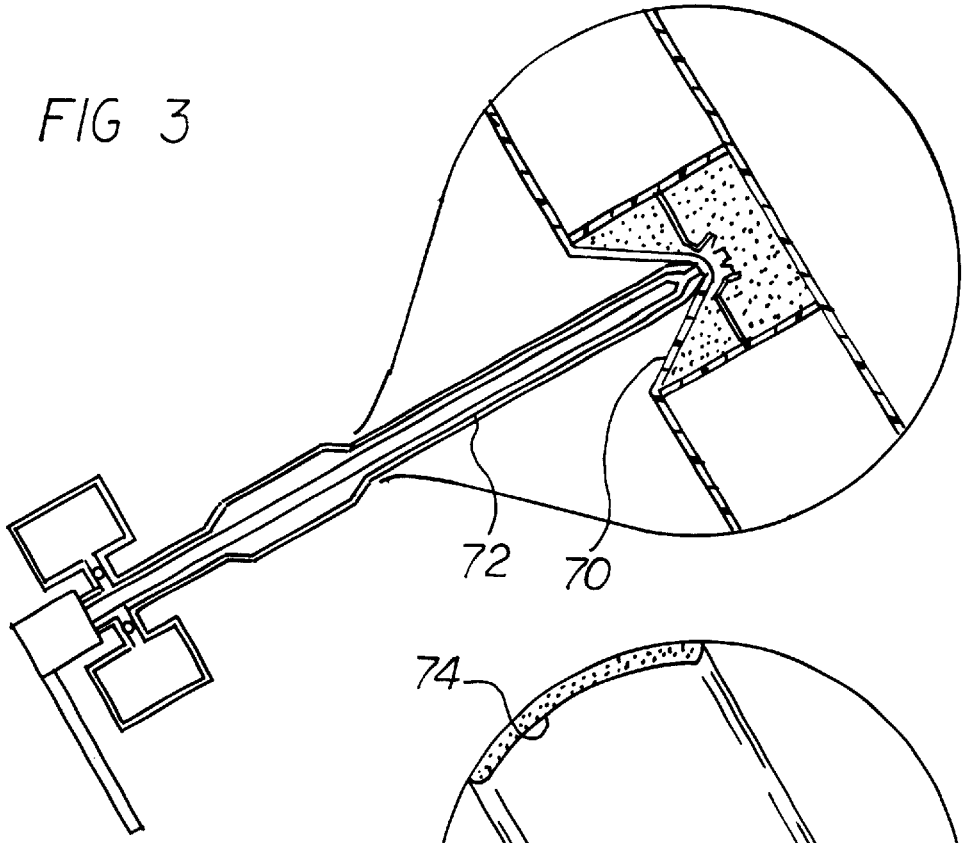
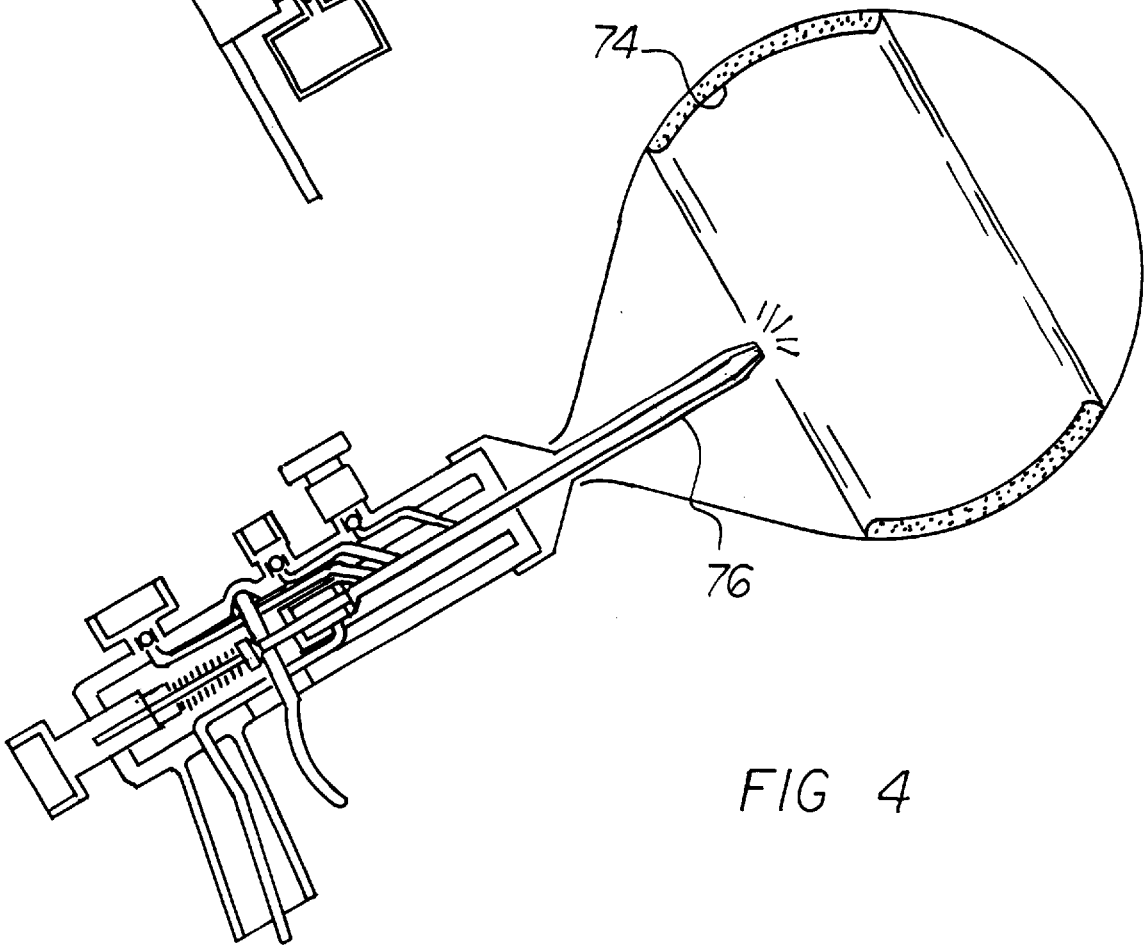
FIG 4

INFLATABLE ILLUMINATION DEVICE

BACKGROUND OF THE INVENTION

1. Field of the Invention

The present invention relates to a inflatable illumination device and more particularly pertains to illuminating balloons through a chemical reaction.

2. Description of the Prior Art

The use of balloons and illuminated objects of known design and configuration is known in the prior art. More specifically, balloons and illuminated objects of known design and configuration previously devised and utilized for the purpose of illuminating objects and inflating balloons by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,141,463 to Rouse, Jr. discloses a method and apparatus for internally sealing and sculpturing elastic membrane expandable containers. U.S. Pat. No. 6,012,826 to Chabert discloses an illuminating balloon with an inflatable envelope and integrated control unit. U.S. Pat. No. 5,609,411 to Wang discloses an inflatable article with an illuminating device. Lastly, U.S. Pat. No. 5,236,383 to Connelly discloses an illuminated toy ball.

While these devices fulfill their respective, particular objectives and requirements, the aforementioned patents do not describe inflatable illumination device that allows illuminating balloons through a chemical reaction.

In this respect, the inflatable illumination device according to the present invention substantially departs from the conventional concepts and designs of the prior art, and in doing so provides an apparatus primarily developed for the purpose of inflatable chemiluminescent system.

Therefore, it can be appreciated that there exists a continuing need for a inflatable illumination device which can be used for illuminating balloons through a chemical reaction. In this regard, the present invention substantially fulfills this need.

SUMMARY OF THE INVENTION

In view of the foregoing disadvantages inherent in the known types of balloons and illuminated objects of known design and configuration now present in the prior art, the present invention provides an improved inflatable illumination device. As such, the general purpose of the present invention, which will be described subsequently in greater detail, is to provide a inflatable illumination device and method which has all the advantages of the prior art and none of the disadvantages.

To attain this, the present invention essentially comprises a balloon. The balloon is fabricated of an elastic, air impervious material, preferably rubber, natural or synthetic or blends thereof. The balloon is generally shaped in a spherical configuration when inflated by air to include an upper extent, a lower extent with an inflation/deflation opening, and an intermediate extent there between. The intermediate extent of the balloon is bounded by an upper plane and a parallel lower plane of a common diameter, with a central plane of a circular configuration having a diameter greater than that of the upper and lower planes. Next provided is an upper circular plate in the upper plane and a lower circular plate in the lower plane. Each plate has apertures there through adjacent to their peripheries to allow the follow of air there through. The upper and lower plates are fabricated of a generally rigid elastomeric material such as polyvinyl chloride. A cylindrical container is next provided. This container has a diameter less than half the diameter of the circular plates. The container has an axial length equal to space between the upper and lower plates. The container has an open upper end sealingly coupled to the upper plate interiorly of the apertures and an open lower end sealingly coupled to the lower plate interiorly of the apertures. The cylinder is fabricated of an elastomeric material with limited flexibility such as polyethylene. Next provided is a circular central disk. The circular central disk is located within the cylinder midway between the upper and lower plates to form an upper chamber there above and a lower chamber there below. The central disk is fabricated of a stiff elastomeric material such as an acetate and is capable of being fracturing when twisted or otherwise distorted through the application of torsional forces. A plurality of luminescent chemicals are provided. The first luminescent chemical is located in the upper chamber and a second luminescent chemical is located in the lower chamber. The chemicals are adapted to intermix upon the application of reverse rotational forces by a user to the upper and lower circular plates for applying a torsional force to the cylinder and central plate for its fracturing. Upon the fracturing of the central plate, the intermixed chemicals will cause an illumination most predominate in the central extent of the balloon which is visible from exteriorly thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a inflatable illumination device which has all of the advantages of the prior art balloons and illuminated objects of known design and configuration and none of the disadvantages.

It is another object of the present invention to provide a inflatable illumination device which may be easily and efficiently manufactured and marketed.

It is further object of the present invention to provide a inflatable illumination device which is of durable and reliable constructions.

An even further object of the present invention is to provide a inflatable illumination device which is susceptible of a low cost of manufacture with regard to both materials and labor, and which accordingly is then susceptible of low prices of sale to the consuming public, thereby making such inflatable illumination device economically available to the buying public.

Even still another object of the present invention is to provide a inflatable illumination device for illuminating balloons through a chemical reaction.

Lastly, it is an object of the present invention to provide an inflatable chemiluminescent system for illuminating balloons through a chemical reaction comprising, includes a balloon fabricated of an elastic, air impervious material, preferably rubber, natural or synthetic or blends thereof. The balloon is generally shaped in a spherical configuration when inflated to include an upper extent, a lower extent with an inflation/deflation opening, and an intermediate extent there between. The intermediate extent of the balloon is bounded by an upper plane and a parallel lower plane of a common diameter, with a central plane of a circular configuration having a diameter greater than that of the upper and lower planes. A plurality of luminescent chemicals with the first luminescent chemical located at the central extent and a second luminescent chemical located at the central extent remote from the first luminescent chemical. The chemicals are adapted to intermix and cause an illumination most predominate at the central extent of the balloon which is visible from exteriorly thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view similar to FIG. 1 but illustrating an alternate embodiment of the invention employing a fill tube to fracture a common wall.

FIG. 4 is a side elevational view similar to FIG. 1 but illustrating but illustrating chemicals being added in the gas and the powder of gel on the inside surface.

The same reference numerals refer to the same parts throughout the various Figures.

DESCRIPTION OF THE PREFERRED EMBODIMENT

Figure 1:
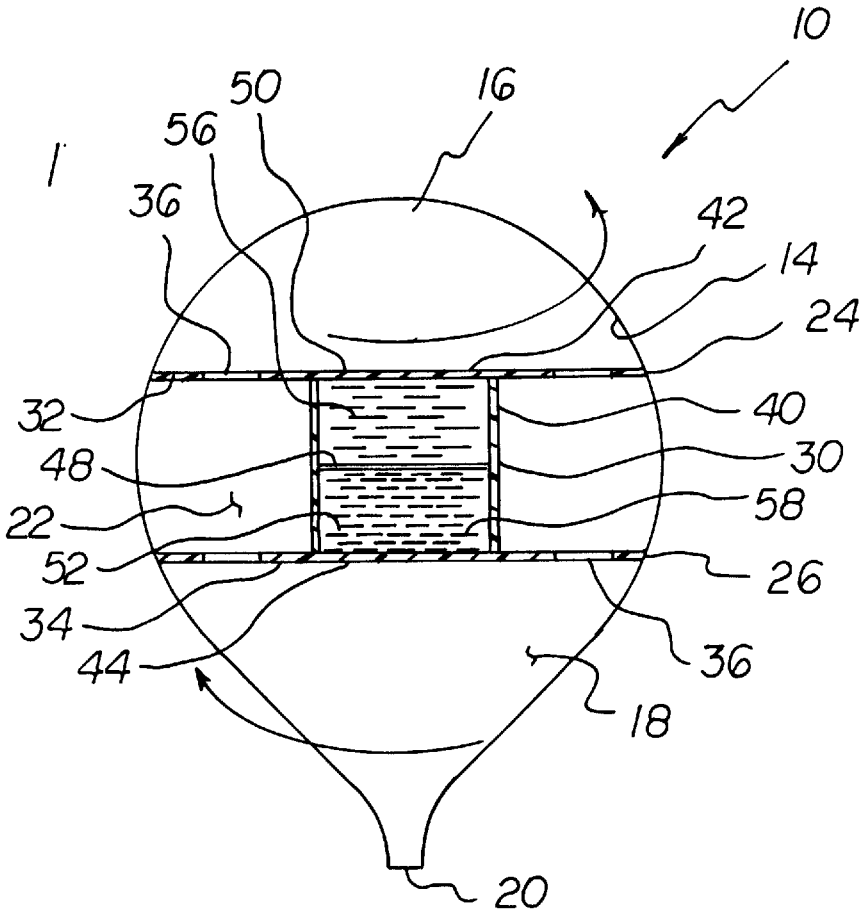
FIG. 1 is a side elevational view with parts shown in a cross section of the inflatable illumination device illustrating the primary embodiment of the invention.

With reference now to the drawings, and in particular to FIG. 1 thereof, the preferred embodiment of the inflatable illumination device embodying the principles and concepts of the present invention and generally designated by the reference numeral 10 will be described.

The present invention, the inflatable illumination device 10 is comprised of a plurality of components. Such components in their broadest context include a balloon, an upper circular plate, a cylindrical container, a circular central disk and a plurality of luminescent chemicals. Such components are individually configured and correlated with respect to each other so as to attain the desired objective.

First provided is a balloon 14. The balloon is fabricated of an elastic, air impervious material, preferably rubber, natural or synthetic or blends thereof. The balloon is generally shaped in a spherical configuration when inflated by air to include an upper extent 16, a lower extent 18 with an inflation/deflation opening 20, and an intermediate extent 22 there between. The intermediate extent of the balloon being bounded by an upper plane 24 and a parallel lower plane 26 of a common diameter, with a central plane 30 of a circular configuration having a diameter greater than that of the upper and lower planes.

Next provided is an upper circular plate 32 in the upper plane and a lower circular plate in the lower plane 34. Each plate has apertures 36 there through adjacent to their peripheries to allow the follow of air there through. The upper and lower plates are fabricated of a generally rigid elastomeric material such as polyvinyl chloride.

A cylindrical container 40 is next provided. This container has a diameter less than half the diameter of the circular plates. The container has an axial length equal to space between the upper and lower plates. The container has an open upper end 42 sealingly coupled to the upper plate interiorly of the apertures and an open lower end 44 sealingly coupled to the lower plate interiorly of the apertures. The cylinder is fabricated of an elastomeric material with limited flexibility such as polyethylene.

Next provided is a circular central disk 48. The circular central disk is located within the cylinder midway between the upper and lower plates to form an upper chamber 50 there above and a lower chamber 52 there below. The central disk is fabricated of a stiff elastomeric material such as an acetate and is capable of being fracturing when twisted or otherwise distorted through the application of torsional forces.

A plurality of luminescent chemicals are provided. The first luminescent chemical 56 is located in the upper chamber and a second luminescent chemical 58 is located in the lower chamber. The chemicals are adapted to intermix upon the application of reverse rotational forces by a user to the upper and lower circular plates for applying a torsional force to the cylinder and central plate for its fracturing. Upon the fracturing of the central plate, the intermixed chemicals will cause an illumination most predominate in the central extent of the balloon which is visible from exteriorly thereof.

In this primary embodiment, the pressure of an upward screwing motion, the same as arrived at when one closes for e.g. a Coca Cola bottle. The pressure of a downward screwing motion, similar as when one opens for e.g. a Coca Cola bottle. The simple "twisting motion" of turning clockwise or anticlockwise, whereby this movement will burst the fractural member, which facilitates the chemical reaction. Two separate compartments, with say one dry and one liquid chemiluminescent substance, being assembled in a way that the may communication when turned in a manner that these will be joined together and are then interacting as one unit. In these aforementioned examples, the substances could be also arranged in the middle of the confined area where the "turning motion" is facilitated. Air, gas, liquid and/or other substances may be used to arrive at the "pressure" to fracture that will facilitate the illumination. In these possible arrangements it is advantageously possible to arrange the chemiluminescent substances in a pre determined manner. This will further facilitate that the substances are interacting at a specific given time. Perhaps in these samples, it will be necessary to ensure that the housing of the substances is separate to the air inlet member of the balloon.

Figure 2:
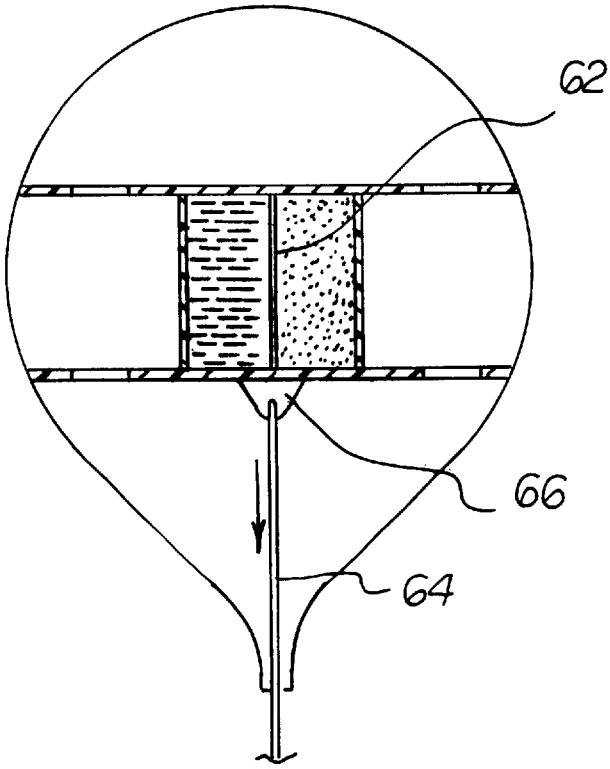
FIG. 2 is a side elevational view similar to FIG. 1 but illustrating an alternate embodiment of the invention employing a pull string to fracture a common wall.

FIG. 2 is a side elevational view similar to FIG. 1 but illustrating an alternate embodiment of the invention employing a pull string to fracture a common wall. In this embodiment, the upper plane includes a horizontal circular upper plate and the lower plane includes a horizontal circular lower plate. A cylindrical container is provided between the upper plate and the lower plate. A rectangular vertical intermediate plate 62 is provided between the upper plate and the lower plate. The vertical intermediate plate divides the space between the upper and lower plates into a first side chamber with a first chemiluminescent material and a second side chamber with a second chemiluminescent material. A rod 64 is provided. The rod extends through the opening. A string 66 couples the rod and the lower plate whereby pulling the rod will deform the lower plate and break the intermediate plate and cause the intermixing of the first and second chemiluminescent materials and the illumination of the system. In this additional method a "light switch" could be attached in a form of a string with a wide ending, and/or an appropriate attachment e.g. rubber ball, which can be pulled at will through a slim tunnel, out of glass/fiberglass and/or plastic, where a frangible membrane is allocated which separates the substances. Here the air-inlet member may be separate to the housing of the substances and/or the balloon. Once the desires object is inflated the string can be pulled to seal the balloon, the destruction of the separating walls of the substances may have occurred when the "string" was under force blown inside the confined area and/or when pulled to seal the balloon. This could also seal the air-outlet of the balloon in another feasible method, advantageously when the air-inlet member is part of the chemiluminescent substances. This string could also be attached manual and/or by mechanical means during inflation of the confined and/or balloon area.

FIG. 3 is a side elevational view similar to FIG. 1 but illustrating an alternate embodiment of the invention employing a fill tube to fracture a common wall. In this embodiment the upper plane includes a horizontal upper plate and the lower plane includes a horizontal circular lower plate. A cylindrical container is provided between the upper plate and the lower plate. A horizontal cylindrical container is provided between the upper and lower plates. A horizontal intermediate plate within the container divides the space between the upper and lower plates into an upper chamber with a first chemiluminescent material and a lower chamber with a second chemiluminescent material. The central section 70 of the lower plate is fabricated of an elastic material such as rubber, natural or synthetic, or blends thereof. A tube 72 is provided. The tube is positionable through the opening to introduce an inflating gas and to also deform the central section, break the intermediate plate, and cause the intermixing of the first and second chemiluminescent materials and illumination of the system. In this additional aspect it could be arranged that simply the tapping at the bottom of the balloon housing ruptures the separating walls of the chemiluminescent substances and/or when the air, be it water and/or oxygen and/or helium, inlet is attached to the balloon's neck/housing. Yet another arrangement could be to facilitate the communication when attaching the container with the substances to the balloon which has a separate air-inlet in a bayonet format of attachment similar to those found in English-UK attachments of electrical light bulbs. Here the manual force while securing the housing to the balloon will facilitate the desired activation of the illumination.

FIG. 4 is a side elevational view similar to FIG. 1 but illustrating chemicals being added in the gas and the powder of gel on the inside surface. The balloon has an interior and an exterior surface with a first chemiluminescent material 74 on the interior surface between the upper plane and the lower plane. Further included is a tube 76 adapted to extend through the opening to introduce into the balloon an inflating gas and a second chemiluminescent material to cause the intermixing of the first and second chemiluminescent materials and the illumination of the system. In this method, chemiluminescent powder may be introduced in a spraying manner into the confined area, e.g. a chemiluminescent gel may be located at a company logo in the center of the balloon whereby the activating chemiluminescent powder is added/ sprayed during the inflation process to facilitate the desired illumination. This powder may be mixed with e.g. helium and/or be simply located/placed over the air inlet of the confined area which will then be sprayed on to the other substance(s) during inflation. Obviously all these spraying effects may also be conducted visa-versa. Further also only one chemiluminescent substance be it in dry/powder form and/or in a liquid form may be mixed with air and/or helium that is to inflate the confined area, whilst the other substance is in a prearranged position. Also the air inlet may be arranged that the dry/powder will have to communicate.

Figure 5:
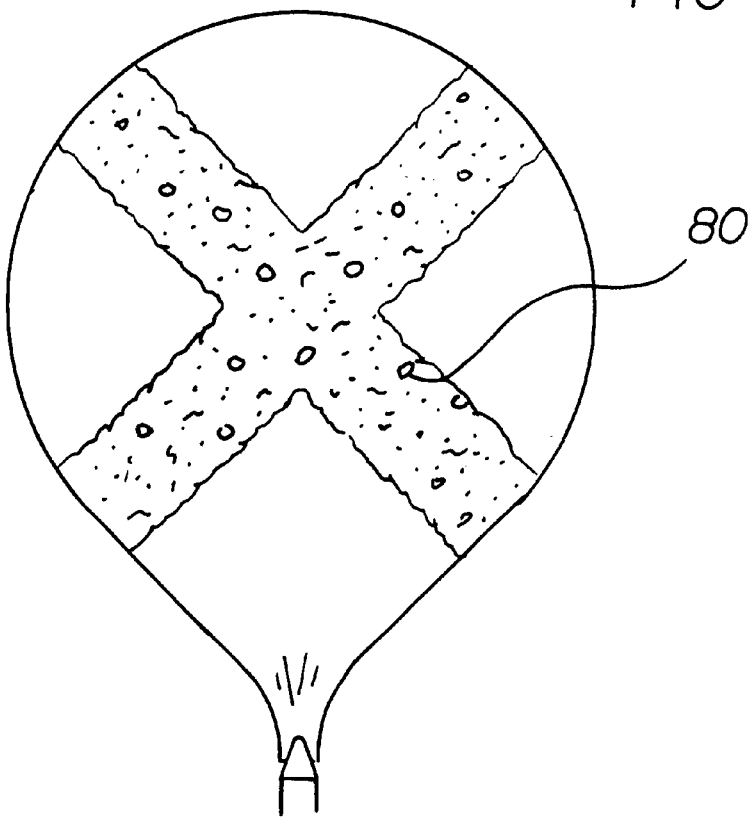
FIG. 5 is a side elevational view similar to FIG. 1 in cross section illustrating a foam impregnated with chemicals activated by a liquid or a gas.

FIG. 5 is a side elevational view similar to FIG. 1 in cross section illustrating a foam impregnated with chemicals activated by a liquid or a gas. The first chemiluminescent material 80 is in the shape of indicia such as a letter, letters, a word, words, or a design for advertising purposes. Another way would be that one chemiluminescent substance may be in a dry and/or powder and/or gel form at a predetermined location so that when the fluid chemiluminescent substances is added the illumination, and/or chemical reaction, can take place. This embodiment, like the FIG. 4 embodiment, allows for the illumination to be in the form of indicia.

Figure 6:
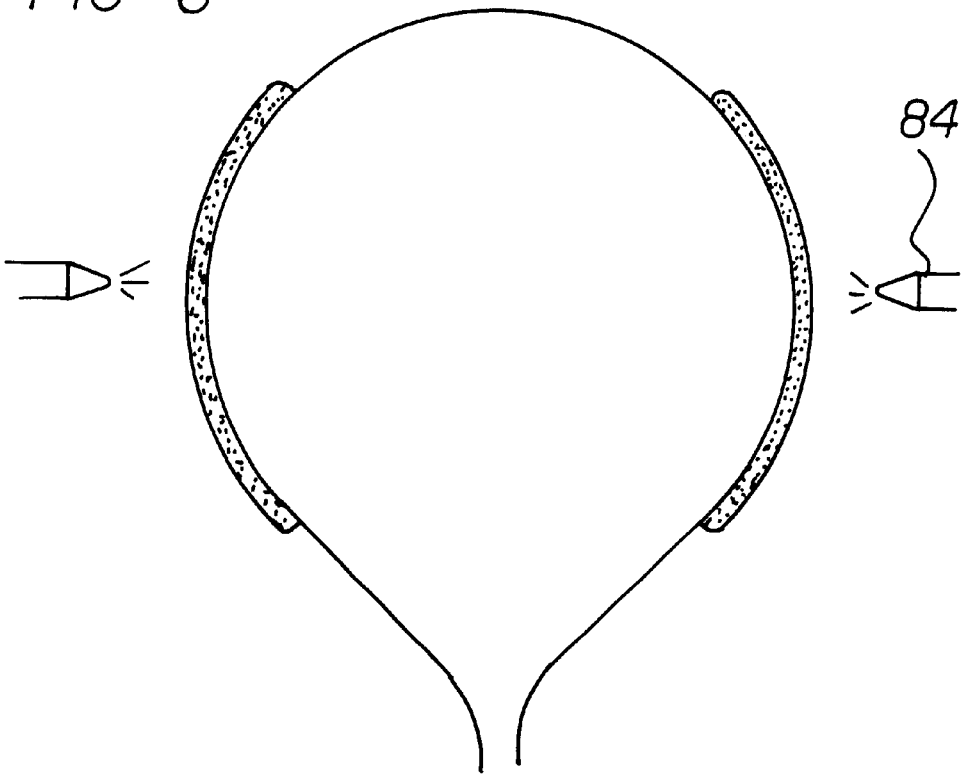
FIG. 6 is a side elevational view illustrating the powder or gel or paint on the outside activated by a liquid or gas.

FIG. 6 is a side elevational view illustrating the powder or gel or paint on the outside activated by a liquid or gas. The balloon has an interior and an exterior surface with a first chemiluminescent material and the exterior surface between the upper plane and the lower plane. Further included is a tube 84 adapted to dispense a second chemiluminescent material onto the first chemiluminescent material to illuminate the system. Obviously it is also possible to have the gel and/or liquid chemiluminescent substances arranged in a predetermined location and have then the dry and/or powered form introduced and/or added to facilitate the illumination.

The inflatable object may have one or more substances in a dry format attached to the walls entirely and/or only at predetermined locations. These may be activated when one and/or more substances and/or moisture is added, say for e.g. during the inflation process. This could be advantageous if a company logo and/or other effect is to be illuminated, as here only the attached in a printed form is to be illuminated, resulting in the desired effects. The substances could be mixed while in a powder form.

It is further possible to activate the activation by simply adding water and/or another neutral liquid to facilitate the desired effect. For example, when the two substances are printed on in some way it would need only an additional substance in liquid form to facilitate the communication of the aforementioned substances. This additional substance may be added in several ways including in a spraying manner, perhaps also during the inflation process.

Another possibility is to have a "string" separating the substances. This may be pulled to let the substances communicate. For example, the string may be wide enough to serve as the divider of the two substances and open pulling may facilitate the communication of the substances and/or break the separating member open pulling. In these examples the then pulled string may still rest within the original housing to ensure that there is no leakage.

Further a compartment may be arranged to absorb perhaps one and/or more fluid/s and/or substances in a dry form that open reaction may form/result in a gel and thus hindering any substances to escape and/or leak from the inflatable object. This absorbent material may be arranged in a desired form/figure and serve as a catalyst to soak up the fluids fully and thus illuminating this form/figure fully.

Yet a further possibility is to have one or more substances soaked into a very water absorbent article, perhaps at ones or in separate stages, or to have these substances added during manufacturing. Once this article is dried again, perhaps during the manufacturing process, then this may be arranged in and/or to the outside of the desired object, may it be inflated or not, and activated via any added substance. This additional substance and/or moisture may advantageously be introduced in a spraying manner.

This absorbent article maybe added to all the above stated feasible ways and further perhaps a Logo constructed out of the absorbent material, which may be arranged in a predetermined area and this may already be coated in one and/or more substances, adjacent to this another substance, perhaps in a liquid form, may be located to be added at a predetermined format and/or time.

Further a water and/or moisture absorbent product, with perhaps one substance coated on it, may have another substance introduced to it in small amounts to facilitate the desired effects.

Various chemiluminescent materials may readily be utilized to cause the intended results of illuminating a balloon. Typical of such materials are those disclosed in the patent literature such as U.S. Pat. No. 3,576,987; 3,860,132; and 4,015,111, the subject matter of which is incorporated herein by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable chemiluminescent system for illuminating balloons through a chemical reaction comprising, in combination:

a balloon fabricated of an elastic, air impervious material, preferably rubber, natural or synthetic or blends thereof, the balloon being shaped in a generally spherical configuration when inflated to include an upper extent, a lower extent with an inflation/deflation opening, and an intermediate extent there between, the intermediate extent being bounded by an upper plane and a parallel lower plane of a common diameter, with a central parallel plane of a circular configuration having a diameter greater than that of the upper and lower planes; and a first luminescent chemical located solely at the intermediate extent and a second luminescent chemical located at the intermediate extent remote from the first luminescent chemical, the chemicals adapted to intermix and cause an illumination most predominate at the intermediate extent of the balloon which is visible from exteriorly thereof;

wherein the upper plane includes a horizontal circular parallel planar lower plate with a cylindrical container there between with a rectangular vertical intermediate plate there between dividing the space between the upper and lower plates into a first side chamber with a first luminescent chemical and a second side chamber with a second luminescent chemical and with a rod extending through the opening with a string coupling the rod and the lower plate whereby pulling the rod will deform the lower plate and break the intermediate plate and cause the intermixing of the first and second luminescent chemicals and the illumination of the system.

2. An inflatable chemiluminescent system for illuminating balloons through a chemical reaction comprising, in combination:

a balloon fabricated of an elastic, air impervious material, preferably rubber, natural or synthetic or blends thereof, the balloon being shaped in a generally spherical configuration when inflated to include an upper extent, a lower extent with an inflation/deflation opening, and an intermediate extent there between, the intermediate extent being bounded by an upper plane and a parallel lower plane of a common diameter, with a central parallel plane of a circular configuration having a diameter greater than that of the upper and lower planes, and a first luminescent chemical located solely at the intermediate extent and a second luminescent chemical located at the intermediate extent remote from the first luminescent chemical, the chemicals adapted to intermix and cause an illumination most predominate at the intermediate extent of the balloon which is visible from exteriorly thereof;

wherein the balloon has an interior surface and an exterior surface with the first luminescent chemical secured to the interior surface in the shape of indicia such as a letter, letters, a word, words, or a design for advertising purposes solely between the upper plane and the lower plane and further including a tube adapted to extend through the opening to introduce into the balloon an inflating gas and the second luminescent chemical and cause the intermixing of the first and second luminescent chemicals and the illumination of the system.

3. An inflatable chemiluminescent system for illuminating balloons through a chemical reaction comprising, in combination:

a balloon fabricated of an elastic, air impervious material, preferably rubber, natural or synthetic or blends thereof, the balloon being shaped in a generally spherical configuration when inflated to include an upper extent, a lower extent with an inflation/deflation opening, and an intermediate extent there between, the intermediate extent being bounded by an upper plane and a parallel lower plane of a common diameter, with a central parallel plane of a circular configuration having a diameter greater than that of the upper and lower plates;

a first luminescent chemical located solely at the intermediate extent and a second luminescent chemical located at the intermediate extent remote from the first luminescent chemical, the chemicals adapted to intermix and cause an illumination most predominate at the intermediate extent of the balloon which is visible from exteriorly thereof;

wherein the balloon has an interior surface and an exterior surface with the first luminescent chemical secured to the exterior surface solely between the upper plane and the lower plane and further including a tube adapted to dispense the second luminescent chemical onto the first luminescent chemical to illuminate the system.

* * * * *